United States Patent [19]

Horie et al.

[11] Patent Number: 4,814,245

[45] Date of Patent: Mar. 21, 1989

[54] ELECTROPHOTOGRAPHIC PHOTORECEPTOR CONTAINING A PHTHALOCYANINE PIGMENT AND A BISHYDRAZONE COMPOUND

[75] Inventors: Seiji Horie; Naonori Makino; Hideo Sato, all of Kanagawa, Japan

[73] Assignee: Fuji Photo Film Co., Ltd., Kanagawa, Japan

[21] Appl. No.: 86,449

[22] Filed: Aug. 18, 1987

[30] Foreign Application Priority Data

Aug. 18, 1986 [JP] Japan ..... 61-191774

[51] Int. Cl.[4] ..... G03G 5/10

[52] U.S. Cl. ..... 430/59; 430/76

[58] Field of Search ..... 430/59, 96, 76

[56] References Cited

U.S. PATENT DOCUMENTS 4,471,039 9/1984 Borsenberger et al. ..... 430/96

4,594,304 6/1986 Watarai et al. ..... 430/59

*Primary Examiner*—John L. Goodrow

*Attorney, Agent, or Firm*—Sughrue, Mion, Zinn, Macpeak & Seas

[57] ABSTRACT

An electrophotographic photoreceptor is described, comprising a photosensitive layer disposed on a conductive substrate, said photosensitive layer having a laminated structure comprising an electric charge generating layer and an electric charge transporting layer, said electric charge generating layer containing a phthalocyanine pigment which is selected from ε-type copper phthalocyanine, aluminum chloride phthalocyanine, vanadyl phthalocyanine, X-type or t-type phthalocyanine, indium chloride phthalocyanine, titanyl phthalocyanine, germanium chloride phthalocyanine, calcium chloride phthalocyanine, and magnesium phthalocyanine, one of the benzene rings of the aluminum chloride or indium chloride phthalocyanine being optionally monochlorinated, and said electric charge transporting layer containing at least one bishydrazone compound as represented by formula (I) or (II)

(I)

(II)

7 Claims, No Drawings

ELECTROPHOTOGRAPHIC PHOTORECEPTOR CONTAINING A PHTHALOCYANINE PIGMENT AND A BISHYDRAZONE COMPOUND

FIELD OF THE INVENTION

The present invention relates to an electrophotographic photoreceptor having a photosensitive layer disposed on a conductive substrate, the photosensitive layer having a laminated structure comprising an electric charge generating layer and an electric charge transporting layer.

BACKGROUND OF THE INVENTION

Basic characteristics required for an electrophotographic photoreceptor include (1) the characteristic that it can be electrified to appropriate potential in a dark place, (2) the characteristic that the electric charge is substantially not dissipated and lost in a dark place, and (3) the characteristic that the electric charge can be rapidly dissipated and lost by irradiating it with light.

Inorganic substances such as selenium, cadmium sulfide, and zinc oxide that have been used to date have many merits, but, at the same time, various deficiencies. For example, selenium, now in wide use, sufficiently meets the above-mentioned conditions (1) to (3), but it has defects in that conditions for preparing it are difficult, it has a high production cost, it is not flexible, it is difficult to process into a belt shape, and it is very sensitive to thermal or mechanical shock so that it must be handled carefully. Cadmium sulfide or zinc oxide is dispersed in a resin as a binder and is used for an electrophotographic photoreceptor, but the phoptoreceptor has deficiencies in mechanical characteristics such as evenness, hardness, tensile strength, friction resistance, and the like, so that it is impossible to use it repeatedly as such.

In recent years, electrophotographic photoreceptors using various organic substances have been proposed to overcome the above-mentioned deficiencies of photoreceptors comprising inorganic substances, and some of them have been put into practice. Examples include an electrophotographic photoreceptor comprising poly-N-vinylcarbazole and 2,4,7-trinitrofluoren-9-one as described in U.S. Pat. No. 3,484,237, an electrophotographic photoreceptor comprising poly-N-vinylcarbazole sensitized with a pyrylium salt-based dye as described in Japanese Patent Publication No. 25658/73, an electrophotographic photoreceptor with an organic pigment base as described in Japanese Patent Application (OPI) No. 37543/72 (the term "OPI" as used herein refers to a "published unexamined Japanese patent application"), and an electrophotographic photoreceptor having an eutectic complex comprising a dye and a resin as the main component as described in Japanese Patent Application (OPI) No. 10785/72.

In addition, an electrophotographic photoreceptor having copper phthalocyanine dispersed in a resin has also been described, particularly in Japanese Patent Publication No. 1667/77.

These organic electrophotographic photoreceptors have mechanical chracteristics and flexibility improved to some extent as compared with the above-mentioned inorganic electrophotographic photoreceptors, but they have, in general, low photosensitivity and are not so suitable for extended repeated use, so that they are not fully satisfactory electrophotographic photoreceptors.

The photoconduction process of electrophotographic photoreceptors comprises:

(1) a process for generating electric charges through exposure, and (2) a process for transporting electric charges.

As an example of electrophotographic photoreceptors in which the processes (1) and (2) are carried out by the same substance, there may be mentioned a selenium photosensitive plate. On the other hand, as an example of electrophotographic photoreceptors in which the processes (1) and (2) are each carried out by a different substance, a combination of amorphous selenium and poly-N-vinylcarbazole is well known. A function-separation type electrophotographic photoreceptor in which the processes (1) and (2) are each carried out by a different substance has advantages in that the range for selection of material can be extended, and consequently electrophotographic characteristics such as sensitivity and reception potential of the electrophotographic photoreceptor are improved, and substances suitable for preparation of coating film of electrophotographic photoreceptor can be selected from an extensive range.

Many function-separation type electrophotographic photoreceptors like this have been proposed, but only a few of these have been put into practice, and even those that have been put into practice have some deficiencies.

It has been proposed to select an electric charge transporting substance to be combined with an electric charge generating substance by taking the ionization potential as a standard, but such is a result of studies on electrophotographic photoreceptors prepared by selection of combination of specific materials of the same kind, so that it lacks generality and it cannot clearly account for electrophotographic characteristics of an electrophotographic photoreceptor prepared by selection between materials of different kinds.

The fact is that the combination of an electric charge generating substance with an electric charge transporting substance is studied largely by the method of trial and error at the present time. For example, with respect to electrophotographic photoreceptors that are characterized by an electric charge transporting substance, there have been made proposals described in Japanese Patent Application (OPI) Nos. 186847/85 (corresponding to U.S. Pat. No. 4,594,304), 196767/85 (corresponding to U.S. application Ser. No. 713,720), 262162/85 (corresponding to U.S. Pat. No. 4,619,880), and 35365/87 (corresponding to U.S. application Ser. No. 894,534). However, these proposed electrophotographic photoreceptors are still unsatisfactory in terms of sensitivity in a long wavelength region and, hence, realization of photoreceptor having a higher sensitivity has been demanded.

SUMMARY OF THE INVENTION

An object of the invention includes providing an electrophotographic photoreceptor having high sensitivity and excellent durability.

In the invention, an electric charge generating layer is formed using a phthalocyanine pigment as an electric charge generating substance, which is selected from $\epsilon$-type copper phthalocyanine, aluminum chloride phthalocyanine, vanadyl phthalocyanine, X-type or $\tau$T-type phthalocyanine, indium chloride phthalocyanine, titanyl phthalocyanine, germanium chloride phthalocyanine, calcium chloride phthalocyanine, and magnesium phthalocyanine, one of the benzene rings of the aluminum chloride or indium chloride phthalocyanine being optionally monochlorinated, an electric charge transporting layer is formed using a bishydrazone compound represented by formula (I) or (II) as set forth below as an electric charge transporting substance, and a lamination-type electrophotographic photoreceptor is formed through the combination of the above-mentioned layers. Thus, an electrophotographic photoreceptor having high sensitivity and excellent durability is obtained by the combination of both substances.

Thus the present invention is directed to an electrophotographic photoreceptor having a photosensitive layer disposed on a conductive substrate, the photosensitive layer having a laminated structure comprising an electric charge generating layer and an electric charge transporting layer, said electric charge generating layer containing a phthalocyanine pigment and said electric charge transporting layer containing at least one bishydrazone compound represented by formula (I) or (II):

(I)

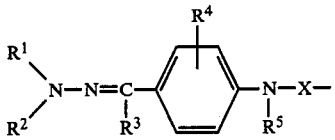

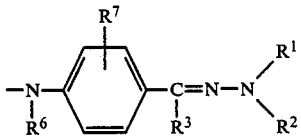

(II)

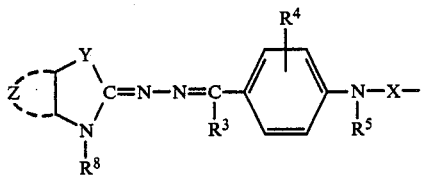

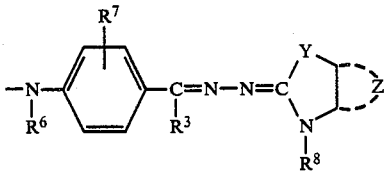

In formulae (I) and (II), $R^1$ and $R^2$, which may be the same or different, each represents unsubstituted or substituted linear or branched alkyl group containing from 1 to 12 carbon atoms, unsubstituted or substituted linear or branched aralkyl group containing from 7 to 20 carbon atoms, or a monovalent aryl group derived from unsubstituted or substituted monocyclic aromatic hydrocarbon of from unsubstituted or substituted condensed polycyclic aromatic hydrocarbon containing from 2 to 4 rings by elimination of one hydrogen atom, or $R^1$ and $R^2$ together form a heterocyclic ring.

$R^3$ represents a hydrogen atom, an unsubstituted or substituted linear or branched alkyl group containing from 1 to 12 carbon atoms, an unsubstituted or substituted aralkyl group containing from 7 to 20 carbon atoms, or an unsubstituted or substituted aryl group.

$R^4$ and $R^7$, which may be the same or different, each represents a hydrogen atom, an unsubstituted or substituted linear or branched alkyl group containing from 1 to 12 carbon atoms, an unsubstituted or substituted aralkyl group containing from 7 to 20 carbon atoms, an unsubstituted or substituted aryl group, a halogen atom, an alkoxy group, or an aryloxy group.

$R^5$, $R^6$, and $R^8$, which may be the same or different, each represents an unsubstituted or substituted linear or branched alkyl group containing from 1 to 12 carbon atoms, an unsubstituted or substituted linear or branched aralkyl group containing from 7 to 20 carbon atoms, or an unsubstituted or substituted aryl group, or $R^5$ and $R^6$ combine to form an N-containing heterocyclic ring.

X is represented by the formula

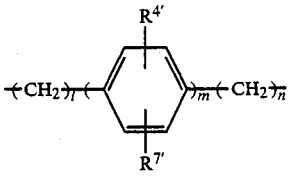

wherein l and n each is 0 or an integer of from 1 to 6, and m is 0 or 1.

$R^{4'}$ and $R^{7'}$ are atoms or groups selected from those defined for $R^4$ and $R^7$ above, or $R^{4'}$ and $R^{7'}$ may combine with each other to form a condensed polycyclic aromatic ring.

Y represents an oxygen atom, a sulfur atom, a selenium atom, an unsubstituted or substituted imino group, or an unsubstituted or substituted methylene group.

Z represents an atomic group forming a benzene or naphthalene ring.

DETAILED DESCRIPTION OF THE INVENTION

The electrophotographic photoreceptor of the invention is prepared by forming a film layer containing a phthalocyanine pigment as an electric charge generating layer on a conductive substrate, and then laminating a layer containing a bishydrazone compound represented by formula (I) or (II) as an electric charge transporting layer on the above-mentioned film layer.

As phthalocyanine pigments for the electric charge generating layer, ϵ-type phthalocyanine, aluminum chloride phthalocyanine, and vanadyl phthalocyanine are preferred, with ϵ-type phthalocyanine and aluminum chloride phthalocyanine being particularly preferred.

Aluminum chloride phthalocyanine used in the invention is represented by the formula

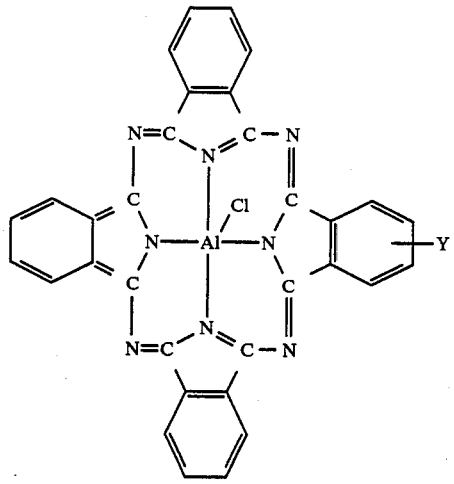

wherein Y represents a hydrogen or chlorine atom and one or benzene rings of the aluminum chloride phthalocyanine may be monochlorinated.

Aluminum chloride phthalocyanine can be synthesized readily by a known method. It can be synthesized by condensation of phthalic anhydride, aluminum chloride, and urea, in the presence or absence of a catalyst, or can be synthesized by use of phthalodinitrile instead of phthalic anhydride. Aluminum chloride phthalocyanine having one monochlorinated benzene ring can be synthesized readily by a method as mentioned in Japanese Patent Application (OPI) No. 211149/82.

Bishydrazone compounds represented by formula (I) or (II) which are used in an electric charge transporting layer in the invention are described in further detail below.

In the above-mentioned formulae (I) and (II), examples of $R^1$ and $R^2$ each being an unsubstituted alkyl group include, as specific examples, methyl group, ethyl group, propyl group, butyl group, pentyl group, hexyl group, octyl group, nonyl group, dodecyl group, isopropyl group, isobutyl group, isopentyl group, 4-methylpentyl group, sec-butyl group, and tert-butyl group. Examples of $R^1$ and $R^2$ as substituted alkyl groups include, as specific examples of the substituent group, chlorine, bromine, and fluorine as a halogen atom; methoxy group, ethoxy group, propoxy group, butoxy group, and pentyloxy group as an alkoxy group; phenoxy group, o-tolyloxy group, m-tolyloxy group, p-tolyloxy group, 1-naphthyloxy group, and 2-naphthyloxy group as an aryloxy group; dimethylamino group, diethylamino group, dipropylamino group, N-methyl-N-ethylamino group, N-ethyl-N-propylamino group, and N-methyl-N-propylamino group as a dialkylamino group; methylthio group, ethylthio group, and propylthio group as an alkylthio group; and piperidino group, 1-piperazinyl group, morpholino group, and 1-pyrrolidyl group as an N-containing heterocyclic group. An alkyl group having at least one substituent group of these substituents bonded to an arbitrary carbon atom of the alkyl group is an example of a substituted alkyl group.

Specific examples of $R^1$ and $R^2$ as unsubstituted aralkyl groups include benzyl group, phenethyl group, 1-naphthylmethyl group, 2-naphthylmethyl group, 1-anthrylmethyl group, and benzhydryl group. If $R^1$ and $R^2$ each is a substituted aralkyl group, specific examples of the substituent group include those above-mentioned and an aralkyl group having at least one substituent group bonded to an arbitrary carbon atom of the aralkyl group is an example of a substituted aralkyl group.

Specific examples of $R^1$ and $R^2$ as unsubstituted aryl groups include a phenyl group, a 1-naphthyl group, a 2-naphthyl group, an anthryl group, a pyrenyl group, an acenaphthenyl group, and a fluorenyl group. Specific examples of the substituent group of $R^1$ and $R^2$ as substituted aryl groups include besides those above-mentioned, methyl group, ethyl group, propyl group, butyl group, pentyl group, isopropyl group, isobutyl group, and isopentyl group as an alkyl group. An aryl group having at least one substituent group of the above substituents bonded to an arbitrary carbon atom of the aryl group is an example of a substituted aryl group.

A specific example of $R^1$ and $R^2$ forming a heterocyclic ring is a carbazole ring.

As two preferred groups represented by $R^1$ and $R^2$, one is a phenyl group and the other is a methyl, ethyl, benzyl, phenyl, or naphthyl group.

In the case of $R^3$ through $R^8$ being an unsubstituted or substituted alkyl, aralkyl, or aryl group, specific examples of such groups include those described above for $R^1$ and $R^2$.

Specific examples of $R^4$ and $R^7$ as a halogen atom, an alkoxy group, or an aryloxy group include chlorine, bromine, and fluorine as the halogen atom; methoxy group, ethoxy group, propoxy group, butoxy group, and pentyloxy group as the alkoxy group; and phenoxy group, o-tolyloxy group, m-tolyoxy group, p-tolyloxy group, 1-naphthyloxy group, and 2-naphthyloxy group as the aryloxy group.

A specific example of $R^5$ and $R^6$ combining with each other to form an N-containing heterocyclic ring group is a piperazine group.

Preferred substituent groups represented by $R^3$ through $R^8$ include a hydrogen atom, a methyl group, an ethyl group, a phenyl group, a benzyl group, a p-(dimethylamino)phenyl group, and a p-(diethylamino)-phenyl group as the group $R^3$; a hydrogen atom, a methyl group, an ethyl group, a methoxy group, an ethoxy group, a bromine atom, a chlorine atom, and a fluorine atom as the group $R^4$ or $R^7$; a methyl group, an ethyl group, an n-butyl group, an n-hexyl group, a benzyl group, and a phenyl group as the group $R^5$ or $R^6$; and a methyl group, an ethyl group, and a benzyl group as the group $R^8$.

Specific examples of X include a methylene group, an ethylene group, a propylene group, a butylene group, a pentylene group, a hexylene group, a laurylene group, a p-xylylene group, a 2,5-dichloro-p-xylylene group, a 2,3,5,6-tetramethyl-p-xylylene group, and a 1,4-dimethylenenaphthalene group.

Preferred examples of X include an ethylene group, a butylene group, a pentylene group, a hxylene group, and a p-xylylene group.

Specific examples of Y include an oxygen atom, a sulfur atom, a selenium atom, an alkylimino group, a dimethylmethylene group, and the like. The alkyl group of the alkylimino group is an alkyl group containing from 1 to 8 carbon atoms. Y is preferably a sulfur atom.

Specific examples of the bishydrazone compound as represented by formulae (I) and (II) are shown below.

(1)
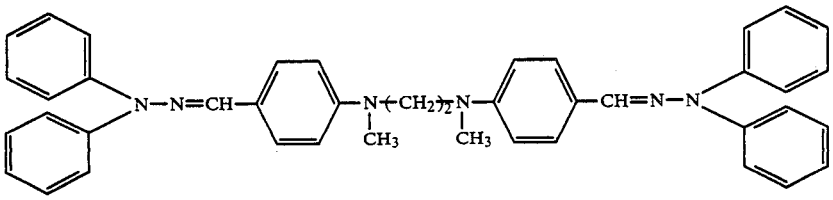
(2)
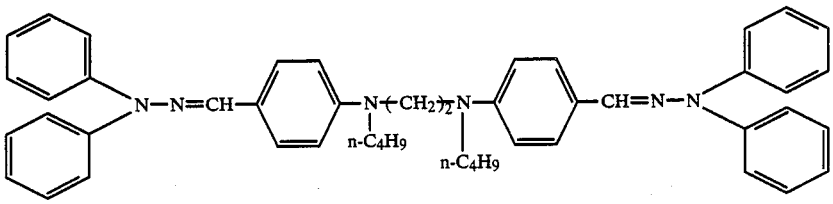
(3)
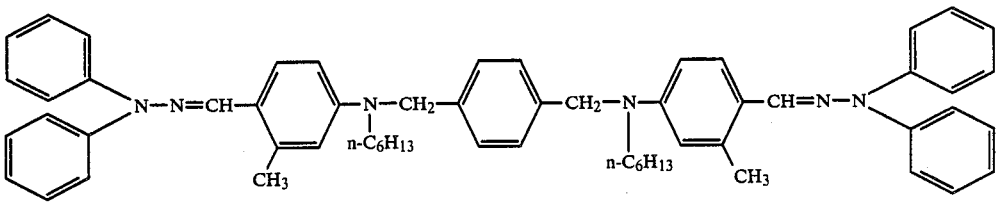
(4)
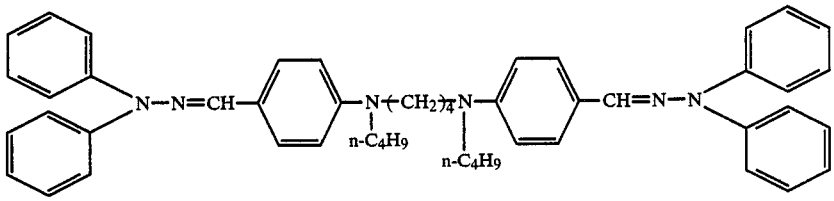
(5)
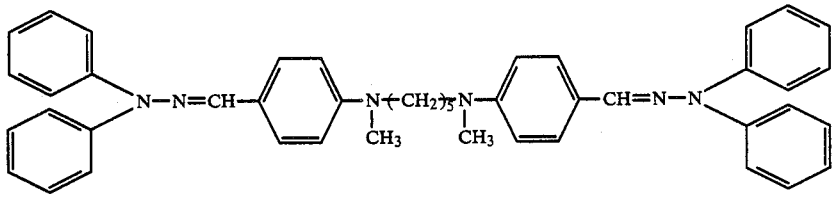
(6)
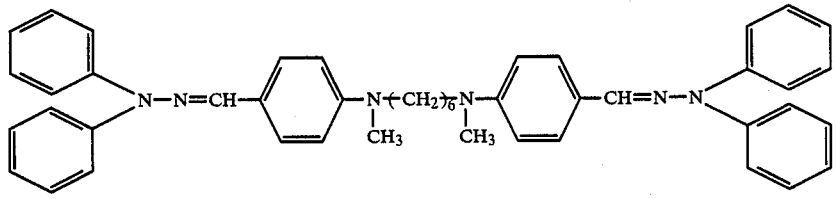
(7)
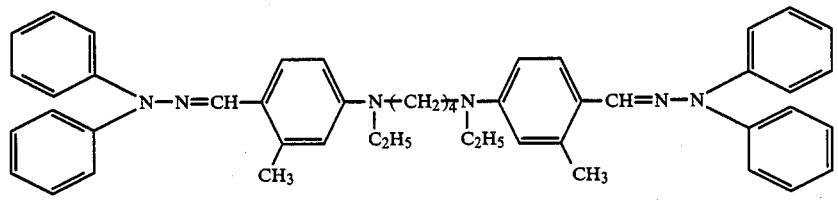

-continued
(8)
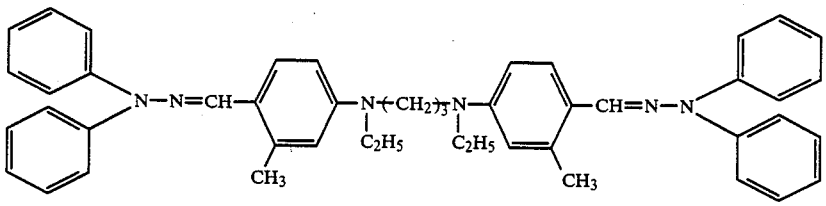
(9)
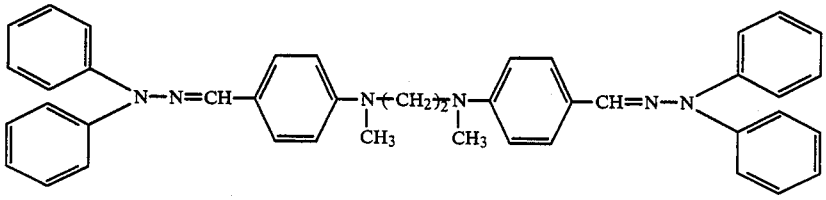
(10)
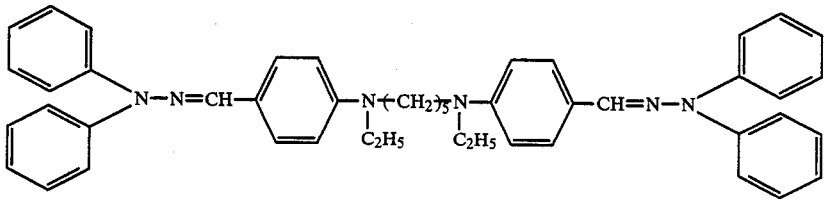
(11)
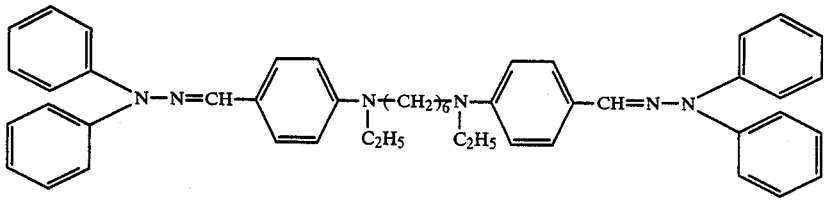
(12)
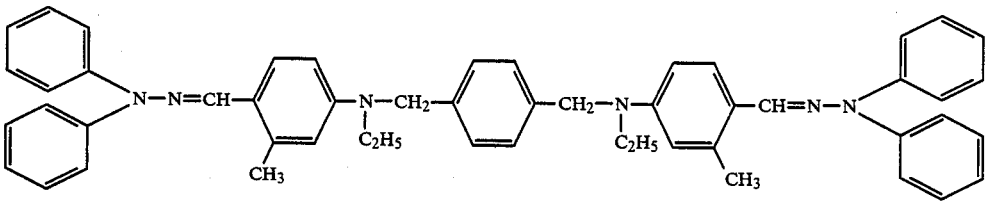
(13)
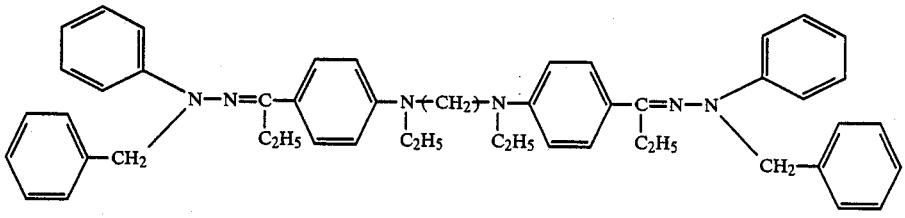
(14)
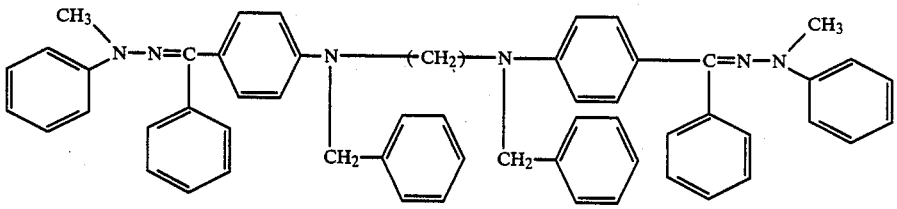

-continued
(15)
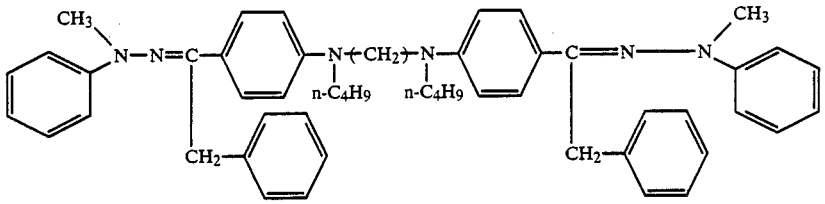
(16)
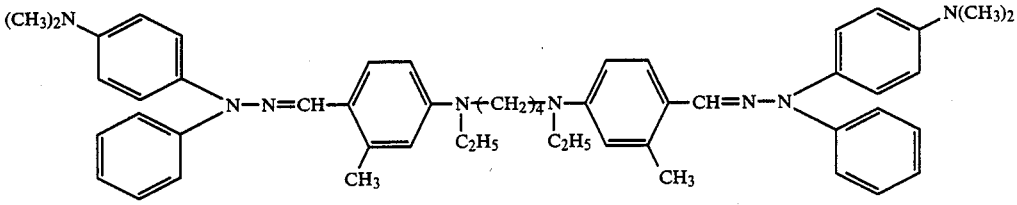
(17)
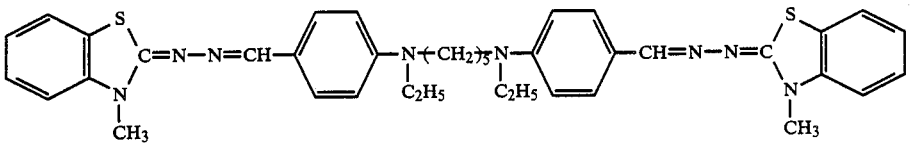
(18)
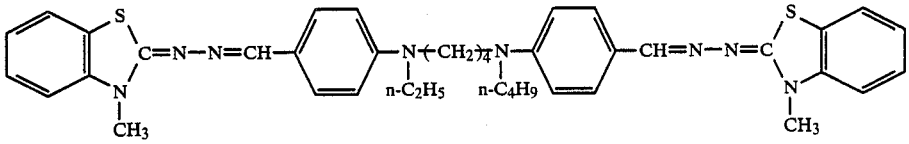
(19)
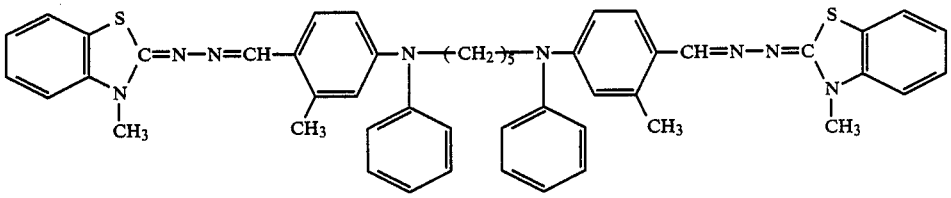
(20)
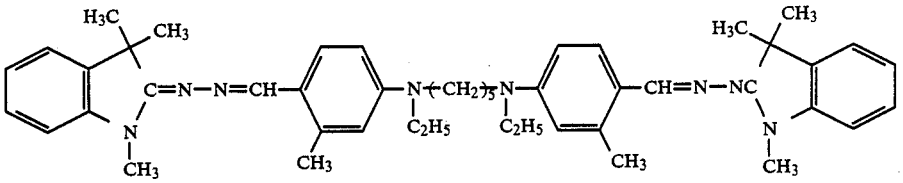
(21)
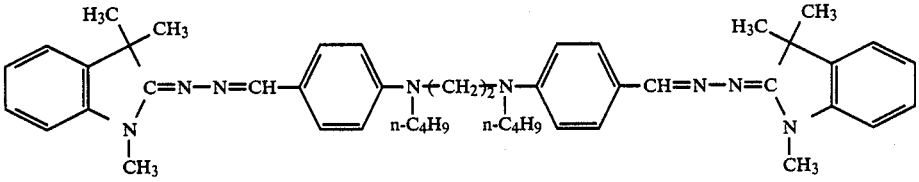
(22)
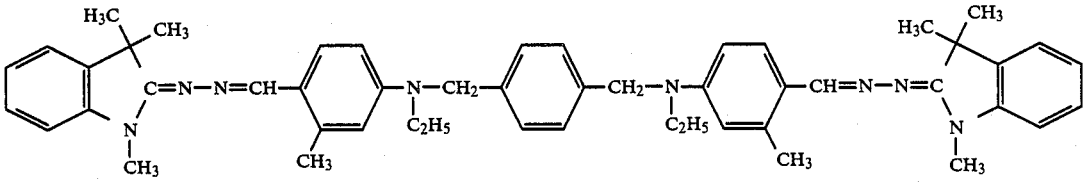

-continued (23)

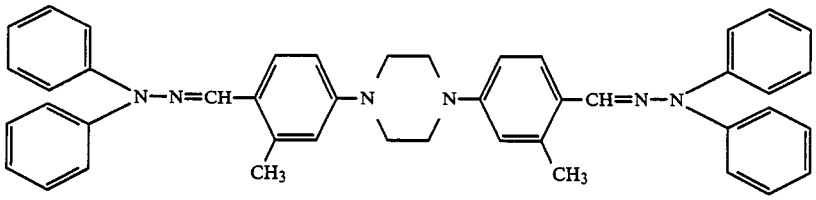

(24)

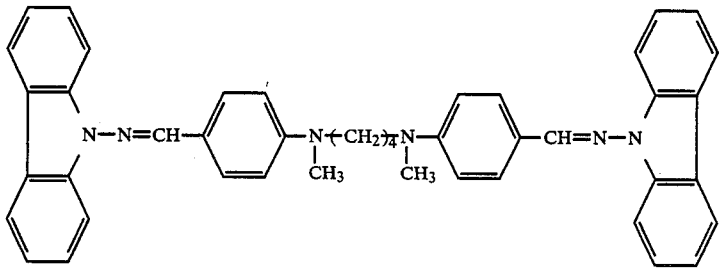

(25)

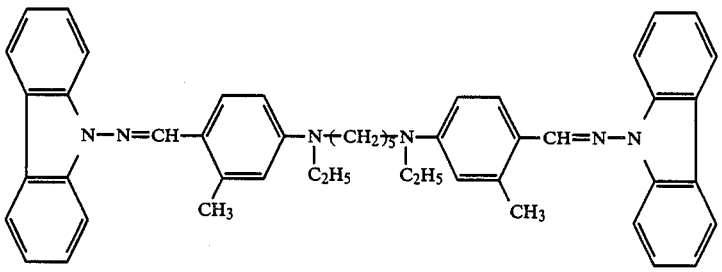

(26)

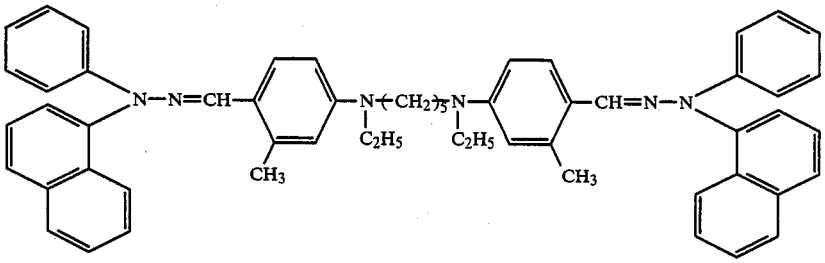

(27)

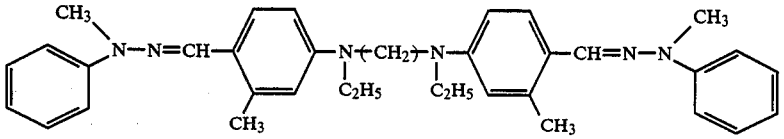

(28)

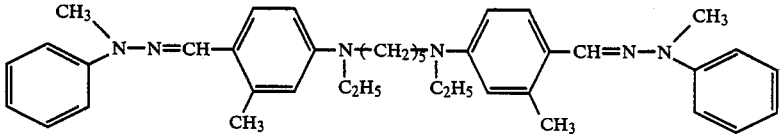

(29)

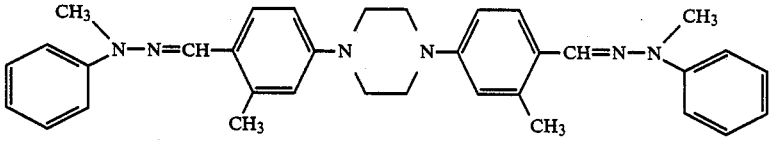

The bishydrazone compounds as represented by formulae (I) and (II) can be prepared by a method as described in Japanese Patent Application (OPI) No. 186847/85. The compounds can be obtained by reacting a hydrazine compound or its mineral acid salt as as represented by formula (IV) or (V) with a bisaldehyde or bisketone compound as represented by formula (VI) in a solvent by a usual method in the presence of a small amount of an acid (glacial acetic acid or an inorganic acid), as required. As the solvent, alcohols such as methanol, ethanol, and the like, tetrahydrofuran, acetic acid, and DMF (dimethylformamide) can be used, in the form of a single compound or as a mixture of two or more compounds.

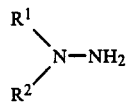
(IV)

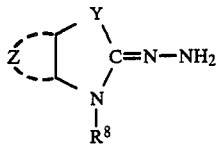
(V)

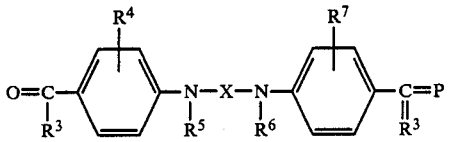
(VI)

$R^1$ through $R^8$, X, Y, and Z is formulae (IV) through (VI) have the same meanings as in formulae (I) and (II).

In laminating an electric charge transporting layer on an electric charge generating layer provided on a conductive substrate to form the electrophotographic photoreceptor of the invention, the electric charge generating layer can be formed by vacuum depositing phthalocyanine pigments on a conductive substrate or by dispersing fine powders of phthalocyanine pigments in an appropriate solvent or in a solvent having a binder dissolved in it, and then applying and drying the dispersion on the conductive substrate. The thickness of the electric charge generating layer is generally 5 microns or less, preferably 2 microns or less.

If the electric charge generating layer is formed by using and applying a binder, it is preferred that the amount of the phthalocyanine pigment used therein is at least 0.1 time the weight of the binder. If the phthalocyanine pigment is used in an amount less than 0.1 time the weight of the binder, sufficient sensitivity of the photoreceptor cannot be obtained.

The phthalocyanine pigment for use in an electric charge generating layer is pulverized into a fine powder having a particle size of 5 microns or less, preferably 2 microns or less, with a grinder such as ball mill, sand mill, vibrtory mill, or the like.

On the thus formed electric charge generating layer, an electric charge transporting layer is disposed which contains a bishydrazone compound represented by formula (I) or (II).

An electric charge transporting layer is disposed by dissolving a bishydrazone compound represented by formula (I) or (II) in a solution of an appropriate binder and then applying and drying the resulting solution by a conventional method. The thickness of the electric charge transporting is generally from 3 to 20 microns, and preferably from 5 to 20 microns. The amount of the electric charge transporting substance used in an electric charge transporting layer is generally from 0.2 to 2 times the weight of the binder, and preferably from 0.3 to 1.3 times the weight of the binder.

In preparing the electrophotographic photoreceptor of the invention, an additive such as a plasticizer, a sensitizer, or the like may be used together with a binder.

As a conductive substrate used in the electrophotographic photoreceptor of the invention, a metallic sheet such as aluminum, copper, zinc, or the like, a plastic sheet or film such as polyester of the like having a conductive material such as aluminum, $SnO_2$, or the like vapor deposited or dispersed and applied on it, or paper electric conduction-treated is used.

As the binder, a higher molecular polymer having hydrophobic properties, a high permittivity, and good forming properties for an electrically insulating film is preferably used. The high molecular polymers, for example, include the following polymers, but the binder is not limited thereto.

Polycarbonates, polyesters, methacryic resins, acrylic resins, polyvinyl chloride, polyvinylidene chloride, polystyrene, polyvinyl acetate, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone-alkyd resins, phenol-formaldehyde resins, styrene-alkyd resins, and poly-N-vinylcarbazole.

These binders can be used in the form of a single resin or of a mixture of two or more resins.

Examples of the plasticizer include biphenyl, biphenyl chloride, o-terphenyl, p-terphenyl, dibutyl phthalate, dimethyl glycol phthalate, dioctyl phthalate, triphenyl phosphate, methylnaphthalene, benzophenone, chlorinated paraffin, polypropylene, polystyrene, dilauryl thiodipropionate, 3,5-dinitrosalicylic acid, various fluorohydrocarbons, and the like.

In addition, a silicone oil or the like may be added to improve the surface properties of the electrophotographic photoreceptor.

Examples of sensitizers include chloranil and tetracycnoethylene.

An adhesion layer or a barrier layer may be disposed between the conductive substrate and the photosensitive layer. As materials used for these layers, there may be mentioned, besides the high molecular polymers used for the above-mentioned binder, gelatin, casein, polyvinyl alcohol, ethyl cellulose, carboxymethyl cellulose, a vinylidene chloride-based polymer latex as described in Japanese Patent Application (OPI) No. 84247/84, a styrene-butadiene-based polymer latex as described of Japanese Patent Application (OPI) No. 114544/84, aluminum oxide, and the like, and the thickness of the layer is preferably 1 micron or less.

The electrophotographic photoreceptor of the invention has been described in detail in the above, and it has characteristics of high sensitivity and excellent durability.

The electrophotographic photoreceptor of the invention can be used for electrophotographic copying machines, and, in addition, can be applied widely to fields such as photoreceptors of printers using a laser or cathode ray tube as a light source.

The invention is described in further detail referring to examples hereinafter but it is not limited to these examples. "Parts" in the examples mean "parts by weight".

EXAMPLE 1

5 parts of ε-type copper phthalocyanine (Liophoton® EPPC, a product of Toyo Ink MGF Co., Ltd.) and a solution prepared by dissolving 10 parts of polyester resin (Vylon® 200, a product of Toyobo Co., Ltd.) in 100 parts of tetrahydrofuran were placed in a ball mill and they were ground and dispersed for 20 min. After that, the dispersion was applied to a conductive substrate (which was a polyethylene terephthalate film having a thickness of 75 microns, having an aluminum film vapor deposited on its surface that had a surface electric resistance of $10^3$ ohms) with a wire round rod and dried to prepare an electric charge generating layer having a thickness of 1 micron.

Next, a solution prepared by dissolving 3.6 parts of an electric charge transporting substance, that is, a compound No. 1, and 4 parts of a polycarbonate of bisphenol A in a mixture of 13.3 parts of dichloromethane and 26.6 parts of 1,2-dichloroethane was applied to the above-mentioned electric charge generating layer with a wire round rod and dried to form an electric charge transporting layer having a thickness of 11 microns. Thus, an electrophotographic photoreceptor having an electrophotographic sensitive layer comprising the above-mentioned two layers was prepared.

The electrophotographic photoreceptor was electrified to −600 V by a corona discharge of −6 kV using a tesing apparatus for static electricity copying paper (SP-428 type, a product of Kawaguchi Denki Co.) and was then irradiated with light emitted from a tungsten lamp of color temperature of 3000° K. and providing illuminance of 2 lux on the surface of the photoereceptor. The time required for attenuation of surface potential from its original value to one-half of that value was measured to determine the exposure required for a reduction by half, $E_{50}$ (lux.sec), and as a result, a value of 2.1 (lux.sec) of $E_{50}$ was obtained. The test comprising two processes of electrification and exposure was repeated 3000 times, and after that, the value of $E_{50}$ hardly changed.

EXAMPLES 2 TO 10

Various electrophotographic photoreceptors were prepared by the same method as in Example 1, except that a bishydrazone compound as shown in Table 1 was used as an electric charge transporting substance instead of the bishydrazone compound No. 1 used in Example 1, and the exposure for reduction by one-half was measured for each of the photoreceptors. The results are shown in Table 1.

TABLE 1

| Example | Electric charge transporting substance No. | $E_{50}$ (lux · sec) |
|---|---|---|
| 2 | 2 | 1.7 |
| 3 | 4 | 1.6 |
| 4 | 6 | 2.3 |
| 5 | 9 | 2.5 |
| 6 | 12 | 3.0 |
| 7 | 15 | 5.6 |
| 8 | 18 | 1.9 |
| 9 | 19 | 1.4 |
| 10 | 25 | 3.3 |

From results of Table 1, it is found that electrophotographic photoreceptors of the invention have high sensitivity.

COMPARATIVE EXAMPLES 1 TO 4

Various electrophotographic photoereceptors were prepared by the same method as in Example 1, except that a comparative compound as set forth below as used as an electric charge transporting substance instead of the bishydrazone compound No. 1 used in Example 1, and the exposure for reduction by one-half was measured for each of the photoreceptors. The results are shown in Table 2.

COMPARATIVE COMPOUNDS

C-1

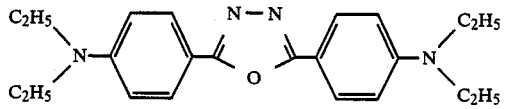

C-2

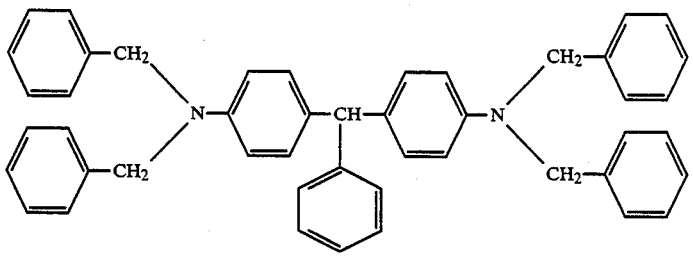

C-3

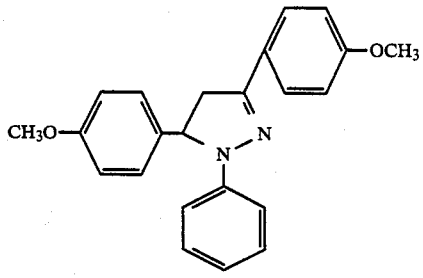

C-4

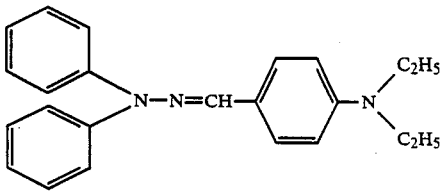

TABLE 2

| Comparative Example | Comparative Compound No. | $E_{50}$ [lux · sec] |
|---|---|---|
| 1 | C-1 | 19.3 |
| 2 | C-2 | 20.1 |
| 3 | C-3 | 18.5 |

TABLE 2-continued

| Comparative Example | Comparative Compound No. | $E_{50}$ [lux · sec] |
|---|---|---|
| 4 | C-4 | 4.8 |

The test comprising two processes of electrification and exposure was repeated 3000 times for the electrophotographic photoreceptor of Example 1 and for Comparative Example 4. Measured values of $E_{50}$ are shown in Table 3.

TABLE 3

| | $E_{50}$ of 1st test | $E_{50}$ after testing 3000 times |
|---|---|---|
| Example 1 | 2.8 | 3.0 |
| Comparative Example 4 | 4.8 | 10.5 |

From the above results, it is clear that the photoreceptor of the invention has high sensitivity, and shows only a very small change in sensitivity after it is used repeatedly, and thus has excellent durability.

EXAMPLE 11

Aluminum chloride phthalocyanine was vapor deposited in a thickness of about 8000 Å on an aluminum substrate under a vacuum of $2\times10^{-6}$ Torr to form an electric charge generating layer.

A bishydrazone compound No. 1 was used as the electric charge transporting substance, and an electrophotographic photoreceptor having a thickness of 12 microns was prepared by the same method as in Example 1.

The laminated photoreceptor was electrified to −600 V by corona discharge of −6 KV. Monochromatic light produced by treating light from a light source of 500 W Xe lamp with a monochromator (a product of Nikon) was applied to the surface of the electrified photoreceptor and surface potential attenuation by light was measured.

An exposure for a reduction by half, $E_{50}$ [erg/cm$^2$], at 800 nm was 5.6 erg/cm$^2$; thus, the photoreceptor had very high sensitivity.

EXAMPLES 12 TO 17 AND COMPARATIVE EXAMPLE 5

Various electrophotographic photoreceptors were prepared by the same method as in Example 11, except that a compound a shown in Table 4 was used as an electric charge transporting substance instead of the bishydrazone compound No. 1.

Measured results of an exposure required for a reduction by half, $E_{50}$, for these photoreceptors are shown in Table 4.

TABLE 4

| Example | Electric charge transporting substance No. | $E_{50}$ (erg/cm$^2$) |
|---|---|---|
| 12 | 2 | 3.9 |
| 13 | 7 | 6.1 |
| 14 | 10 | 5.5 |
| 15 | 12 | 6.0 |
| 16 | 19 | 3.5 |
| 17 | 27 | 4.4 |
| Comparative Example 5 | Comparative Compound No. C-4 | 12.1 |

As is clearly shown by the results, the photoreceptor of the invention has high sensitivity and it has only a very small change of sensitivity after being used many times repeatedly, so that it has excellent durability. The effect has been obtained as a result of a combination of a phthalocyanine pigment with a bishydrazone compound represented by the formula (I) or (II) in a lamination type electrophotographic photoreceptor.

While the invention has been described in detail and with reference to specific embodiments thereof, it will be apparent to one skilled in the art that various changes and modifications can be made therein without departing from the spirit and scope thereof.

What is claimed is:

1. An electrophotographic photoreceptor comprising a photosensitive layer disposed on a conductive substrate, said photosensitive layer having laminated structure comprising an electric charge generating layer and an electric charge transporting layer, said electric charge generating layer containing a phthalocyanine pigment which is selected from ϵ-type copper phthalocyanine and aluminum chloride phthalocyanine, one of the benzene rings of the aluminum chloride being optionally monochlorinated, and said electric charge transporting layer containing at least one bishydrazone compound as represented by formula (I) or (II)

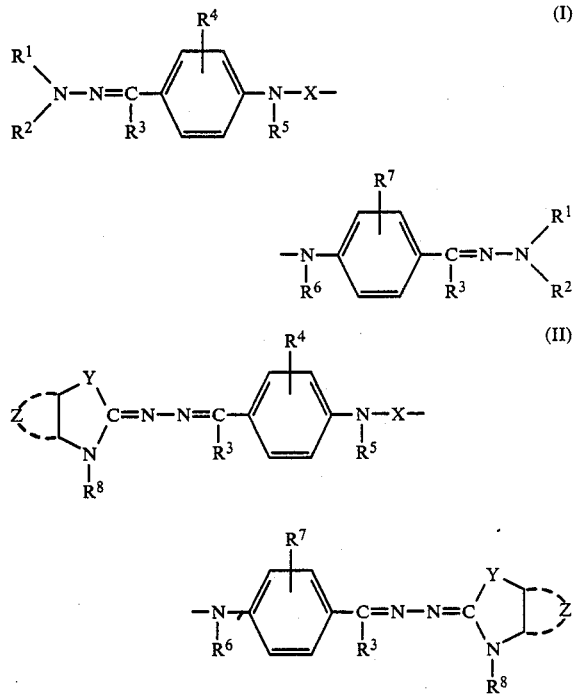

(I)

(II)

wherein $R^1$ and $R^2$ each represents an unsubstituted or substituted linear or branched alkyl group containing from 1 to 12 carbon atoms, an unsubstituted or substituted linear or branched aralkyl group containing from 7 to 20 carbon atoms, or a monovalent aryl group derived from a monocyclic aromatic hydrocarbon or from a condensed polycyclic aromatic hydrocarbon containing from 2 to 4 rings by elimination of one hydrogen atom, or $R^1$ and $R^2$ together form a heterocyclic ring;

$R^3$ represents a hydrogen atom, an unsubstituted or substituted linear or branched alkyl group containing from 1 to 12 carbon atoms, an unsubstituted or substituted aralkyl group containing from 7 to 20 carbon atoms, or an unsubstituted or substituted aryl group;

$R^4$ and $R^7$ each represents a hydrogen atom, an unsubstituted or substituted linear or branched alkyl group containing from 1 to 12 carbon atoms, an unsubstituted or substituted aralkyl group containing from 7 to 20 carbon atoms, an unsubstituted or substituted aryl group, a halogen atom, an alkoxy group, or an aryloxy group;

$R^5$, $R^6$, and $R^8$ each represents an unsubstituted or substituted linear or branched alkyl group containing from 1 to 12 carbon atoms, an unsubstituted or substituted linear or branched aralkyl group containing from 7 to 20 carbon atoms, or an unsubstituted or substituted aryl group, or $R^5$ and $R^6$ combine to form an N-containing heterocyclic ring;

X is represented by the formula

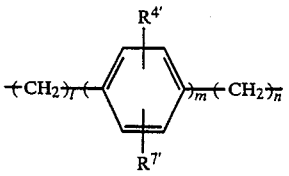

wherein l and n each is 0 or an integer of 1 to 6, and m is 0 or 1;

$R^{4'}$ and $R^{7'}$ are atoms or groups selected from those defined for $R^4$ and $R^7$ above, or $R^{4'}$ and $R^{7'}$ combine to form a condensed polycyclic aromatic ring;

Y represents an oxygen atom, a sulfur atom, a selenium atom, an unsubstituted or substituted imino group, or an unsubstituted or substituted methylene group; and Z represents an atomic group forming a benzene or naphthalene ring.

2. An electrophotographic photoreceptor as in claim 1, wherein one of $R^1$ and $R^2$ is a phenyl group and the other thereof is a methyl, ethyl, benzyl, phenyl, or naphthyl group;

$R^3$ represents a hydrogen atom, a methyl group, an ethyl group, a phenyl group, a benzyl group, a p-(dimethylamino)phenyl group, or a p-(diethylamino)phenyl group;

$R^4$ and $R^7$ each represents a hydrogen atom, a methyl group, an ethyl group, a methoxy group, an ethoxy group, a bromine atom, a chlorine atom, or a fluorine atom;

$R^5$ and $R^6$ each represents a methyl group, an ethyl group, an n-butyl group, an n-hexyl group, a benzyl group, or a phenyl group;

$R^8$ represents a methyl group, an ethyl group, or a benzyl group;

X represents an ethylene group, a butylene group, a pentylene group, a hexylene group, or a p-xylylene group; and Y represents a sulfur atom.

3. An electrophotographic photoreceptor as in claim 1, wherein said electric charge generating layer has a thickness of 2 microns or less.

4. An electrophotographic photoreceptor as in claim 2, wherein said electric charge generating layer has a thickness of 2 microns or less.

5. An electrophotographic photoreceptor as in claim 1, wherein said electric charge transporting layer has a thickness of from 5 to 20 microns.

6. An electrophotographic photoreceptor as in claim 2, wherein said electric charge transporting layer has a thickness of from 5 to 20 microns.

7. An electrophotographic photoreceptor as in claim 1, wherein said electric charge transporting layer further comprises a binder, and the amount of the bishydrazone compound in said electric charge transporitng layer is from 0.3 to 1.3 times the weight of the binder.

* * * * *